United States Patent [19]

Jones et al.

[11] 4,343,835

[45] Aug. 10, 1982

[54] METHOD AND APPARATUS FOR TREATING OPEN-WEAVE SUBSTRATES WITH FOAM

[75] Inventors: Allen P. Jones, Charleston; Charles J. Cunningham, Elkview, both of W. Va.

[73] Assignee: Union Carbide Corporation, Danbury, Conn.

[21] Appl. No.: 217,437

[22] Filed: Dec. 17, 1980

[51] Int. Cl.[3] ..... B05D 1/26; B05C 3/152

[52] U.S. Cl. ..... 427/209; 8/151; 8/477; 68/200; 118/410; 118/413; 118/415; 427/244; 427/358

[58] Field of Search ..... 118/404, 405, 410, 413, 118/415, 411; 427/209, 244, 373, 356, 358; 68/200; 8/151, 477

[56] References Cited

U.S. PATENT DOCUMENTS 4,023,526 5/1977 Ashmus et al. ..... 118/410

4,099,913 7/1978 Walter et al. ..... 252/8.6 X

*Primary Examiner*—Evan K. Lawrence

*Attorney, Agent, or Firm*—Francis M. Fazio

[57] ABSTRACT

Method and apparatus for applying foam to an open-weave substrate. The apparatus contains angled shear strips to shear the foam positioned above a foam outlet. The shear strips, enclosed at each end, define a chamber above the foam outlet having open top and bottom sides for sequential contact of both sides of the substrate with the foam as the substrate travels across the outlet and both open top and bottom sides of the chamber.

6 Claims, 3 Drawing Figures

METHOD AND APPARATUS FOR TREATING OPEN-WEAVE SUBSTRATES WITH FOAM

BACKGROUND OF THE INVENTION

Within the past decade many efforts have been made to reduce costs and environmental pollution during the treatment of substrates. One of the effective means developed has been the use of foam or froth to apply the treating composition to the substrate. Particularly effective has been the use of the foams described and claimed in U.S. Pat. No. 4,099,913 issued on July 11, 1978 to Walter et al and the apparatus described and claimed in U.S. Pat. No. 4,023,526 issued on May 17, 1977 to Ashmus et al, both assigned to Union Carbide Corporation. The technology disclosed in these two patents has found wide international commercial acceptance in the textile and paper industries, particularly in the treatment of close-weave fabrics such as sheeting, denim, corduroy, chambray, twill, non-woven and similar textile materials, and paper products. While this technology can also be used to apply foams to open-weave fabrics such as casement, leno or lace, there has been some difficulty in achieving uniform application to both sides of the open-weave products; the equipment and method disclosed in this application overcome many of the difficulties heretofore experienced with such fabrics.

SUMMARY OF THE INVENTION

This invention is directed to an improvement in the apparatus used to apply a foam to an open-weave substrate and to the method for applying the foam with the improved apparatus. The improvement is an auxiliary component means that can be used with essentially any foam application apparatus employed for the treatment of an open-weave substrate; it is normally attached to the foam applicator at the point where the foam contacts the open-weave substrate as the open-weave substrate is moved across the applicator head or nozzle. The auxiliary component comprises angled shear strips to shear the foam enclosed at each end to define a chamber above the applicator head having open top and bottom sides for sequential contact of both sides of the substrate with the foam as the substrate travels across the head and both open top and bottom sides of the chamber. The invention also includes the method by which the open-weave substrate is treated with the improved apparatus.

DESCRIPTION OF THE INVENTION

In the instant invention an auxiliary component means is applied to a foam applicator head that enables one to achieve essentially uniform application of the foamed treating composition to both sides of an open-weave substrate or fabric with a predetermined and controlled amount of treating composition and at a high rate of application. This can be accomplished with essentially no pollution of the environment and with little or no waste of treating composition. The auxiliary component means and foam application apparatus and method are more fully described below. For purposes of simplicity and ease of description the apparatus described and claimed in U.S. Pat. No. 4,023,526 is used to describe the use and application of the auxiliary component. While the description is predominantly based on that apparatus, an engineer, scientist, or other person skilled in the art would have no difficulty or problem in the use of the herein disclosed invention or auxiliary component means with other forms of apparatus used for the application of foamed compositions to an open-weave substrate. Hence, the description and claims are not to be construed as restricted to the specific apparatus used herein to describe the invention.

The general practice employed in the treatment of a substrate with a foamed composition is to provide means for foaming a composition, conveying the foam to an applicator head and contacting the foam at such head with the substrate. The different forms of apparatus and means for conducting these functions, as well as related functions necessary, are readily available and fully described in the literature; they are also well known to those of ordinary skill in the art and therefore do not require extensive discussion here.

As previously indicated, the apparatus described in U.S. Pat. No. 4,023,526 is eminently suited for the treatment of certain substrates with foams; also eminently suited for application to the substrates are the foams described in U.S. Pat. No. 4,099,913. When the teachings of these two patents are employed in conjunction with the auxiliary component means of this invention, the results achieved were completely unexpected and could not have been predicted, even in view of other known techniques, when the foam composition was to be applied to an open-weave substrate.

The auxiliary component means that comprises this improved invention comprises two or more angled shear strips situated or mounted parallel to the orifice of the foam applicator head that are enclosed at each end by means such that the shear strips and the end means define a chamber space open at both top and bottom above the orifice. In practice, the auxiliary component means is situated above the applicator head and is spaced to permit the substrate, e.g. an open-weave fabric, to pass between the applicator head and one edge of the angled shear strips of the auxiliary component means. The open-weave substrate then passes around a turn roll and is returned over the other edge of the angled shear strips, thereby presenting the other side of the open-weave substrate to the foam. The use of the auxiliary component means apparatus of this invention permits the use of a single foam applicator nozzle to uniformly apply foam to both sides of an open-weave substrate. The shear strips on the auxiliary component means can be fixed or their angle can be adjustable.

It is to be noted that figures and angles are not drawn to scale and are presented to facilitate discussion and understanding of the claimed invention. It is also to be noted that the figures do not show the details of the foam applicator head, the means for generating the foam and conducting it to the foam applicator head, or the means for conveying the substrate to and across the foam applicator head. Note also that the substrate is presumed to be traveling in the direction indicated by the arrow.

Foams have been uniformly applied to close-weave substrates in the past with known types of apparatus. Using such procedures flame retardants, water-proofing agents, water repellants, wash-wear compositions, softeners, latexes, soil release agents, lubricants, builders, dyes and pigments, sizing agents, whiteness, brighteners, bleaches, binders for non-woven products, scouring agents, as well as other components used to treat fabrics and papers have been successfully applied with uniform application. These successes result from the ability to uniformly apply the foam to the substrate followed by essentially uniform penetration into the close weave of the substrate when the foam bubbles are sheared or broken at the nozzle-fabric interface or shortly thereafter and the resulting liquid is uniformly absorbed by the fibers. However, when an open-weave substrate is involved, some foam escapes through the openings without being sheared or broken and then deposits non-uniformly on the back side of the open-weave substrate. This uneven appearance or treatment of the open-weave substrate is undesirable and efforts have been made to resolve the problem, such as by the use of two foam applicators to apply foam separately to both sides of the open-weave substrate.

We have now found an improved apparatus for the uniform treatment of open-weave substrates and methods for treating such substrates.

Figure 1:
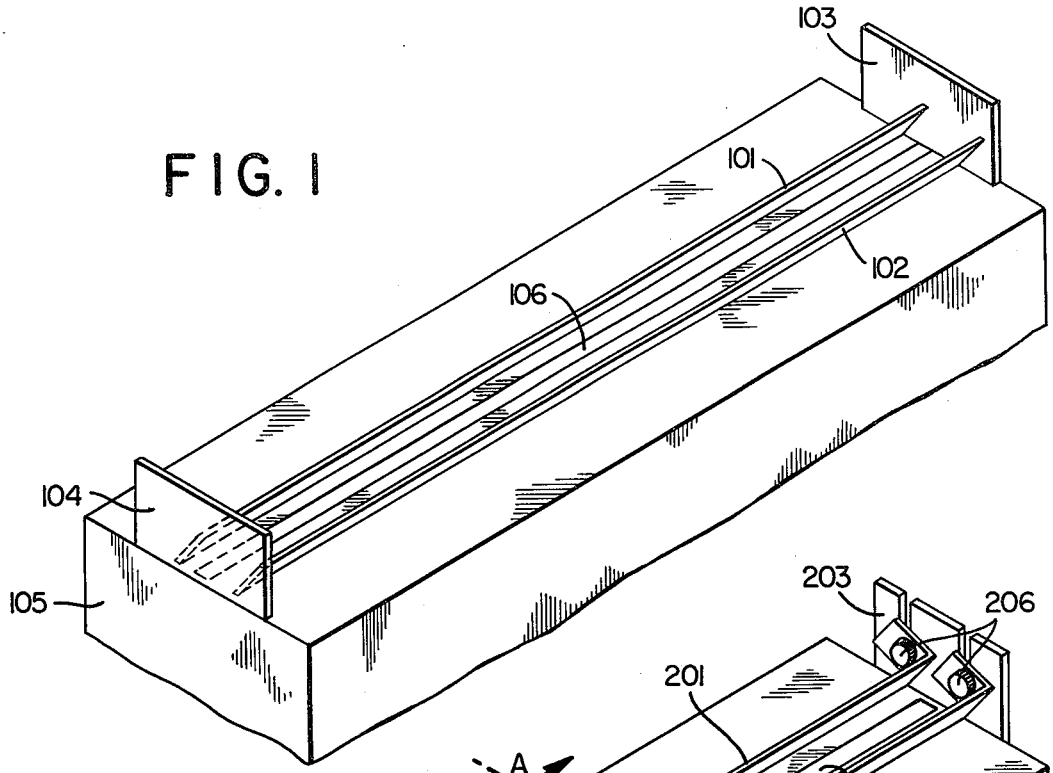
FIG. 1 is a schematic drawing of an auxiliary component means apparatus having two fixed angled shear strips mounted on a foam applicator head.

Referring to FIG. 1 of the drawings there is shown an overhead view of the auxiliary component means apparatus of this invention mounted on a foam applicator apparatus. In this drawing the auxiliary component means comprises shear strips 101 and 102 fixedly attached at an angle to end means 103 and 104, which also serve as means for attaching the auxiliary component means to the foam applicator apparatus 105. The details of the foam applicator apparatus are not shown in any of the drawings since these are so well known to those of ordinary skill in the art. The auxiliary component means is mounted on the foam applicator apparatus such that the shear strips 101 and 102 straddle the orifice means 106 through which the foam exits from the foam applicator apparatus 105. In operation foam is introduced through the orifice 106 of the foam applicator apparatus 105 into the space or chamber formed by the two shear strips 101 and 102 and the end means 103 and 104. Simultaneously the open-weave substrate is continuously conducted across and between the orifice 106 of the foam applicator apparatus 105 and the edges of shear strips 101 and 102 closest to the foam applicator apparatus 105, then passes over a turn-around roller and the opposite surface of the substrate then passes across the other edges of shear strips 101 and 102. During operation the space between the two surfaces of the open-weave substrate, the two shear strips 101 and 102 and the end means 103 and 104 essentially fills with foam. In this manner the foam is uniformly sequentially applied to both surfaces of the open-weave substrate. There can be more than two shear strips if desired, but adequate results are achieved with two.

Figure 2:
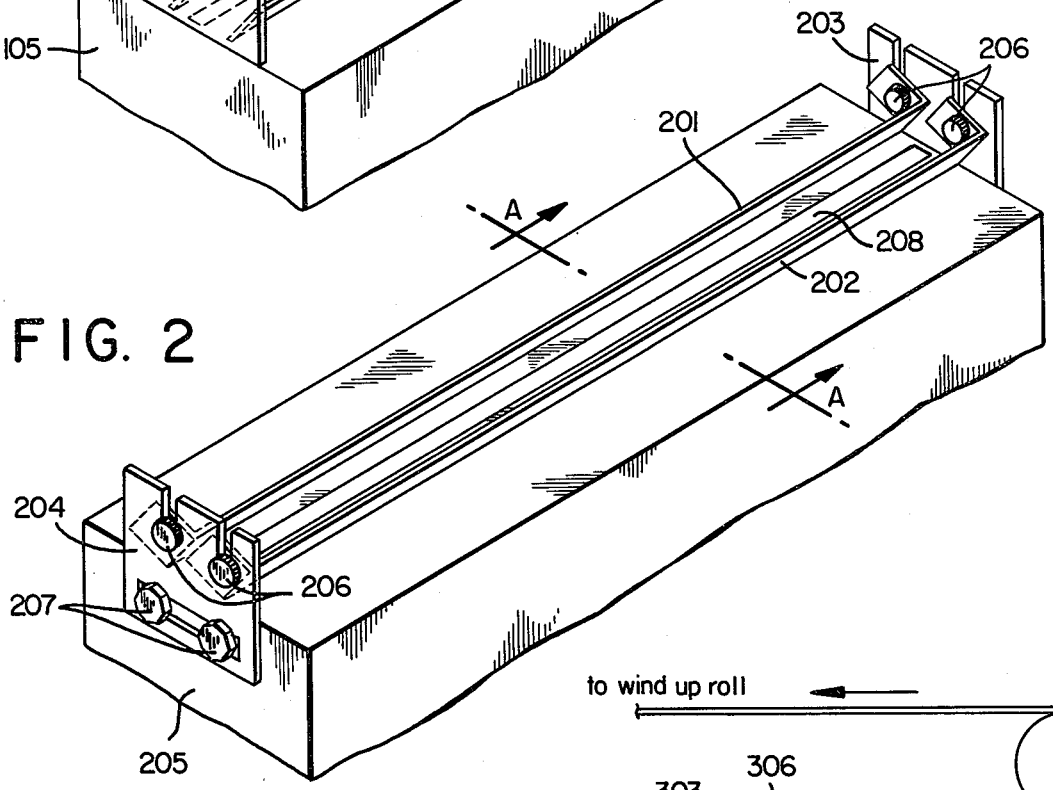
FIG. 2 is a schematic drawing of an auxiliary component means apparatus having two adjustable angled shear strips mounted on a foam applicator head.

Referring to FIG. 2 of the drawings there is shown an overhead view of an auxiliary component means apparatus of this invention having adjustable angle shear strips mounted on a foam applicator apparatus. In this drawing the auxiliary component means comprises adjustable shear strips 201 and 202 mounted to end means 203 and 204 by bolting or similar means 206. The entire assembly is in turn mounted to both sides of the foam applicator apparatus 205 by bolting or similar means 207. As in FIG. 1, the auxiliary component means is mounted on the foam applicator apparatus such that the shear strips 201 and 202 straddle the orifice means 204 through which the foam exits from the foam applicator apparatus 205.

Figure 3:
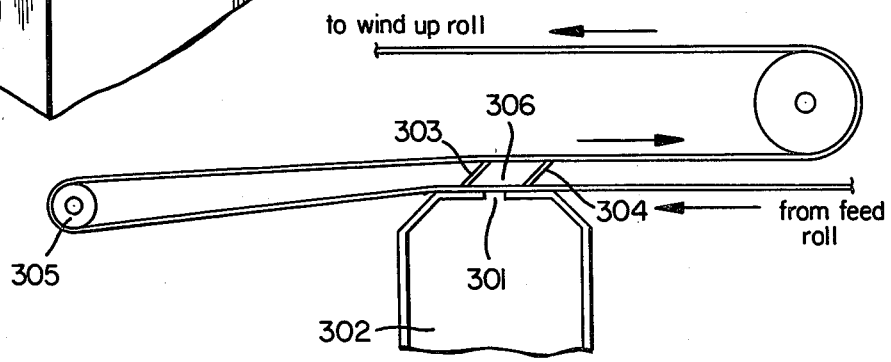
FIG. 3 is a schematic drawing of the end view of an auxiliary component means apparatus of the type shown in FIGS. 1 and 2 mounted on a foam applicator head showing the direction of travel of the open-weave substrate across the foam applicator apparatus of this invention.

FIG. 3 represents a side view along the plane A—A of FIG. 2, and illustrates the path of the substrate. The drawing illustrates the feeding of the open-weave substrate from a feed roll across the orifice 301 of foam applicator apparatus 302 and between the orifice 301 of foam applicator apparatus 302 and the edges of shear strips 303 and 304 closest to the foam applicator apparatus and then proceeding over a turn-around roller 305 and back across the other edges of shear strips 303 and 304 to contact the opposite surface of the substrate with the foam in area 306; from there it proceeds to a wind-up roll or for further treatment prior to wind-up if desired.

In a typical operation a liquid formation is prepared containing the chemical components desired to be applied and those necessary for the production of a foam. The formulation is frothed or foamed in the foam applicator apparatus and conveyed via the orifice to the surface of the substrate in the manner previously indicated; particularly suitable foams are described in U.S. Pat. No. 4,099,913 and particularly suitable foam applicator apparatuses to which the auxiliary component means can be attached are described in U.S. Pat. No. 4,023,526. The operating conditions, when using the auxiliary component means of this invention, are similar to those described in these two patents.

In the use of the improved apparatus of this invention, which comprises foam applicator means and the auxiliary component means, a functional treating formulation or composition containing the functional reagent that is to be added to the fabric is foamed in a foaming apparatus. The term functional treating composition or variants thereof is used in this application to define a formulated composition containing a reactive or functional reagent that is used to treat a porous substrate such as an open-weave fabric or paper to impart a desired physical or chemical property thereto. These functional treating compositions are used to produce the foams applied to the substrate with the improved apparatus of this invention and contain the foaming agent, functional chemical, wetting agent, water and other additives, as identified and in the necessary concentration. The equipment used for producing a foam is well known and many different types are commercially available. The composition, in the foam of a foam, is then conveyed to the foam applicator head where it is transferred to the surface of the open-weave textile material that is to be treated. The manner in which the foam is transferred to the material is critical for uniform distribution on to the fabric. It has been found that use of the improved apparatus and methods of this invention provide uniform application to the open-weave substrate. It was also observed that the manner in which the transfer is made, the specific density and bubble size, and the stability of the foam are also significant.

The foam is usually generated in commercially available foam generating devices, which generally consist of a mechanical agitator capable of mixing metered quantities of a gas, such as air, and a liquid chemical composition containing the functional treating agent or chemical that is to be applied to the fabric and converting the mixture to a foam. It has been found that the density of the foam, its average bubble size and the stability or foam half-life of the foam are important factors. The foam density can range from 0.005 to 0.3 grams per cc, preferably from 0.01 to 0.2 gram per cc.

The foams generally have an average bubble size of from about 0.05 to 0.5 millimeters in diameter and preferably from 0.08 to 0.45 millimeters in diameter. The foam half-life is from 1 to 60 minutes, preferably from 3 to 40 minutes.

The foam density and foam half-life are determined by placing a specified volume of the foam in a laboratory graduated cylinder of known weight, a 100 cc or 1,000 cc cylinder can be used, determining the weight of the foam in the cylinder, and calculating the density from the volume and weight of the foam in the cylinder.

From the measured foam density and volume, and the known density of the precursor liquor, the liquor volume which would equal one-half of the total weight of the foam in the cylinder is calculated. The foam half-life is the time for this volume of liquid to collect in the bottom of the cylinder.

The foam bubble size is measured on a sample of foam taken at the applicator nozzle and is determined by coating the underside of a microscope glass slide with the foam, placing the slide on the microscope, supporting the slide on each end by two slides, and photographing it at once, preferably within 10 seconds, with a Polaroid camera at a magnification of 32 fold. In an area of the photomicrograph measuring 73 by 95 mm, corresponding to an actual slide area of 6.777 square millimeters, the number of bubbles is counted. The average bubble diameter size in mm, is then determined by the equation:

$$\text{Average Bubble Size} = \frac{2}{\sqrt{\pi}}\left[\frac{(6.77)(\text{Liquid Density} - \text{Foam Density})}{\text{No. of Bubbles}}\right]^{\frac{1}{2}}$$

Not only does the use of the auxiliary component means permit uniform application of the foam to both sides of an open-weave substrate by the use of a single applicator nozzle, but it permits better control of the pressures in the foam applicator apparatus itself. Further, it is relatively inexpensive, contains no energy consuming moving parts, is easy to install and when not required can be readily removed so that it does not interfere with other operations, it is easy to operate and thus requires no special attention or operational expertise.

The shear strips are positioned so that the edges form an angle to the plane of the substrate, which is also the horizontal plane of the end means or of the top of the foam applicator apparatus. This angle formed by the edges can vary from 3° to 90°, preferably from 3° to 60° and most preferably from 5° to 45°. The shear strips are positioned from about 5 mm to about 100 mm, or more, apart, preferably from about 10 mm to about 50 mm. Preferably, the shear strips are essentially parallel spaced apart from each other. The spacing between them is sufficiently wide to include the entire width of the orifice through which the foam exits the foam applicator apparatus. The shear strips can be constructed from any suitable material. Thus it can be formed from a thin flat strip of material (e.g. wood, plastic, metal, glass, etc.), or a strip having one or both longitudinal edges bent to form a desired angle, or it can be a relatively thick strip of material whose edges along the longitude have been machined to a desired angle. Other modifications would be readily apparent to a skilled engineer.

As has been indicated, the auxiliary component means is situated in an essentially parallel position in relation to the orifice opening along the length of the nozzle. However, there need not be absolute parallelism between the two provided the orifice is within the space between the shear strips of the auxiliary component means.

The use of the auxiliary component means of this invention to treat open-weave substrates was compared to other means that might be suitable for use with a single foam applicator apparatus. In one such comparison a screen was inserted between the two passes of open-weave substrate over the orifice; the results were erratic in that uniform application to the substrate was not always achieved. In another such comparison the open-weave substrate was turned and passed back over the orifice area in close contact with the back side of the first pass of the substrate over the orifice; again the results were not acceptable. Of course, the use of two applicators, each to apply finish to opposite sides of the fabric, produced uniform application on each side. However, in addition to the added cost of equipment, splitting the foam flow uniformly and applying equal amounts of each side proved to be a tedious task; it was difficult to provide essentially equal flow rates to both sides of the open-weave substrate. The use of a single blade above the open-weave substrate, to spread foam that passed through the openings onto the back side of the substrate, was also attempted and failed to give uniform application.

The following is a typical embodiment of the improved apparatus of this invention and of the methods for using it to apply foam to an open-weave substrate.

The apparatus comprised a foamer, means for conveying the foam to a foam applicator apparatus, and the foam applicator apparatus with the auxiliary component means attached thereto. The foamer was an Oakes Former Model No. 8MB5A connected by suitable conduit means to the foam applicator apparatus.

The foam applicator apparatus used was as described in U.S. Pat. No. 4,023,526. The foam was delivered to the foam applicator that consisted of a lower foam distribution chamber with a foam applicator chamber and nozzle mounted thereto above a foam distribution plate; the nozzle had an orifice along its length. Attached to the nozzle was the auxiliary component means with the angled shear strips straddling and essentially parallel to the orifice, as described in the discussions relating to FIGS. 1 and 2. The internal dimensions of the lower foam distribution chamber were a length of about 23 cm, a width of about 5.1 cm and a height of about 5.1 cm; the foam conduit means from the foamer were attached to an inlet in the base of this lower chamber. Above this chamber was an apertured foam distribution plate, the aperture being a slot 1.58 mm wide and 23 cm long. Above the foam distribution plate was the foam applicator chamber which extended the full 23 cm length of the foam applicator head, had a height of 5.1 cm above the foam distribution plate and a nozzle orifice slit width of 4.76 mm between the two nozzle lips thereof, the ends of the foam applicator head were sealed with end seals. The space between the lips and the end seals is the foam application chamber. The downstream nozzle lip tapered inwardly and downwardly towards the orifice of the foam applicator nozzle at an angle of 5°. Situated on the foam applicator head was the auxiliary component means or unit constructed as described in FIG. 1. This unit was attached with the angled shear strips 101 and 102 essentially parallel to the nozzle orifice 106 as shown in FIG. 1. The shear strips were at an angle of 5° with the horizontal plane of the top of the foam applicator head and the unit was attached to the foam applicator head to provide a space of sufficient height between it and the head for the open-weave substrate to pass through. Means were also provided for feeding and recovering the open-weave substrate and for turning the substrate in order to present both sides of the substrate to the shear strips in sequential order.

The above-described apparatus was used to apply a textile finishing and dye fixing formulation to a previously dyed formulation to a previously dyed open-weave "casement-type" fabric following the procedure described below. The formulation contained the following components:

| | | |
|---|---|---|
| Dimethylol dihydroxyethylene urea (52% solids content) | 1917.5 | g |
| Cationic fixer for direct dyes (49.1% solids content) | 284.5 | g |
| Cationic polyethylene emulsion (18% solids content) | 572.1 | g |
| Magnesium chloride catalyst Solution, (35% solids content) | 572.6 | g |
| Red dye (tracer) | 60 | g |
| Water | 2653 | g |
| Adduct of mixed $C_{11}$ to $C_{15}$ linear alcohols with 20 moles of ethylene oxide | 60 | g |
| Adduct of same mixture of alcohols with 7 moles of ethylene oxide | 30 | g |
| Sodium hydrocarbon sulfate | 60 | g |

This formulation had a total solids content of about 24 weight percent.

In operation the formulation was fed to the foamer at a rate of 106.7 cc per minute and air at the rate of 4,850 cc per minute to produce a foam having a foam density of 0.022 g/cc and a foam half-life of 14 minutes. The foam was fed through a conduit to the foam applicator apparatus fitted with the auxiliary coponent means described supra. The foam pressure in the foam application chamber was seven inches of water. A dyed open-weave casement fabric about 23 cm wide weighing 3.6 ounces per square yard was treated with the foam, which was applied at a total wet pick-up of 25 percent based on the weight of the fabric and that corresponds to a solids add-on rate of about 25 weight percent. In operation, the fabric was passed between the orifice 301 and the shear strips 303 and 304 at which point it made its first contact with the foam. The bottom side of the fabric initially contacted the upstream orifice lip and then contacted the downstream lip of the orifice with unused foam passing through the spaces in the fabric into area 306, the bottom side of the fabric then contacted the lower edge of shear strip 303, passed over the turn-roll 305 and across the upper edges of shear strips 303 and 304 where the opposite surface then contacted the foam present in area 306. From there the fabric proceeded to a windup roll. In this manner uniform application of the formulation to both sides of the open-weave fabric was achieved as observed by the use of the tracer dye. During the application of the foam the fabric was moving across the orifice at a speed of 15.24 meters per minute, this resulted in an initial contact time over the orifice of 0.0188 second.

For comparative purposes the same formulation was applied using the foam applicator apparatus and a single scraper blade above the open-weave fabric to spread and break the foam that passed through the fabric opening. Non-uniform application was noted on the blade side of the fabric. In another comparison a screen was placed over the fabric above the orifice and the fabric conveyed between the screen and the orifice. One side of the fabric was initially contacted with the foam as it exited from the orifice and the fabric was then returned using the turn-roll, over the top of the screen to contact the opposite side of the fabric with foam that had passed through the fabric openings and screen. Essentially, the screen was placed between two passes of the fabric (one on each side) and over the orifice. Again non-uniform application was noted. In both comparisons the same conditions were employed.

What is claimed is:

1. In an apparatus for the treatment of an open-weave substrate with a foam, which apparatus comprises means for conveying said open-weave substrate, foam generating means, foam conduit means, foam applicator means, and orifice means in the top of said foam applicator means to provide exit of the foam for contact thereof with said open-weave substrate as the open-weave substrate travels across said orifice; the improvement of having situated above said orifice means an auxiliary component means, said auxiliary component means comprising two or more angled shear strips to shear said foam spaced apart from each other and enclosed at each end by end means, said shear strips straddling said orifice and together with said end means defining a chamber spaced above said orifice having open top and bottom sides for sequential contact of both sides of said open-weave substrate with the foam as said open-weave substrate travels across said orifice and both open top and bottom sides of said chamber of said auxiliary component means; said angled shear strips positioned (a) essentially parallel with the length of said orifice and at an angle of from 3° to 90° to the plane of the top of said foam applicator means and (b) defining a space between said angled shear strips and the surface of said foam applicator means to permit passage of the open-weave substrate therebetween.

2. An apparatus as claimed in claim 1, wherein the angled shear strips are fixedly attached to the end means at an angle of from 3° to 60° to the plane.

3. An apparatus as claimed in claim 1, wherein the angled shear strips are adjustably attached to the end means.

4. An applicator as claimed in claim 1, wherein the angled shear strips are at an angle of from 5° to 45° to the plane.

5. A method for treating an open-weave substrate with foam delivered through the orifice of foam applicator means by continuously conveying said substrate between the orifice of the foam applicator means and an auxiliary component means having angled shear strips to shear said foam so as to essentially uniformly apply the foam composition to both sides of said substrate, which method comprises conveying said substrate between the orifice and the edges of the angled shear strips of the auxiliary component meas closest to the orifice to uniformly apply foam to the side of the substrate facing the orifice and then conveying the opposite side of said substrate across the opposite edges of the angled shear strips of the auxiliary component means to uniformly apply foam to said opposite side of the substrate, said auxiliary component means comprising two or more of said angled shear strips essentially parallel to each other and enclosed at each end by end means, said shear strips straddling said orifice and together with said end means defining a chamber above said orifice having open too and bottom sides, whereby there is achieved sequential contact of both sides of said open-weave substrate with the foam as said open-weave substrate travels across said orifice and both open sides of said chamber of said auxiliary component means; said angled shear strips (a) defining an angle of from 3° to 90° with the plane of the substrate and positioned essentially parallel with the length of said orifice and (b) defining a space between said angled shear strips and the surface of said foam applicator means to permit passage of the open-weave substrate therebetween.

6. A method as claimed in claim 5, wherein said angle is from 5° to 45°.

* * * * *